US006064021A

United States Patent [19]

Wehrli et al.

[11] Patent Number: 6,064,021

[45] Date of Patent: May 16, 2000

[54] CLUTCH ASSEMBLY FOR ELECTRICAL SWITCHING APPARATUS WITH LARGE COMPRESSION CLOSE SPRING

[75] Inventors: Henry Anthony Wehrli, Monroeville; William John Jones, Cranberry Township, both of Pa.; Alfred Eugene Maier, Sun City West, Ariz.; Raymond Clyde Doran, Jeannette, Pa.

[73] Assignee: Eaton Corporation, Cleveland, Ohio

[21] Appl. No.: 09/392,010

[22] Filed: Sep. 8, 1999

[51] Int. Cl.[7] ..... H01H 5/00

[52] U.S. Cl. ..... 200/400

[58] Field of Search ..... 200/400, 401, 200/424; 192/12 BA, 41 S, 41 R

[56] References Cited

U.S. PATENT DOCUMENTS 3,648,529 3/1972 Illman et al. ..... 74/112
4,885,444 12/1989 Lazar et al. ..... 200/401

*Primary Examiner*—Michael L. Gellner
*Assistant Examiner*—Nhung Nguyen
*Attorney, Agent, or Firm*—Martin J. Moran

[57] ABSTRACT

A clutch assembly for an electrical switching apparatus which has a close spring working in conjunction with a cam disposed on a cam shaft, wherein the close spring provides a rotational force to the cam shaft in a forward direction. The spring clutch is disposed on the cam shaft and allows the cam shaft to rotate in the forward direction but prevents rotation of the cam shaft in the opposite direction.

12 Claims, 13 Drawing Sheets

CLUTCH ASSEMBLY FOR ELECTRICAL SWITCHING APPARATUS WITH LARGE COMPRESSION CLOSE SPRING

CROSS REFERENCES TO RELATED APPLICATIONS

This application is related to the following commonly owned, filed Patent Applications:

- Ser. No. 09/074,240, ELECTRICAL SWITCHING APPARATUS WITH MODULAR OPERATING MECHANISM FOR MOUNTING AND CONTROLLING LARGE COMPRESSION CLOSE SPRING;
- Ser. No. 09/074,135, "ELECTRICAL SWITCHING APPARATUS WITH CONTACT FINGER GUIDE";
- Ser. No. 09/074,046, "ELECTRICAL SWITCHING APPARATUS WITH OPERATING CONDITION INDICATORS MOUNTED IN FACE PLATE";
- Ser. No. 09/074,075, "ELECTRICAL SWITCHING APPARATUS WITH IMPROVED CONTACT ARM CARRIER ARRANGEMENT";
- Ser. No. 09/074,073, "CHARGING MECHANISM FOR SPRING POWERED ELECTRICAL SWITCHING APPARATUS";
- Ser. No. 09/074,233, "ELECTRICAL SWITCHING APPARATUS WITH PUSH BUTTONS FOR A MODULAR OPERATING MECHANISM ACCESSIBLE THROUGH A COVER PLATE";
- Ser. No. 09/074,104, "INTERLOCK FOR ELECTRICAL SWITCHING APPARATUS WITH STORED ENERGY CLOSING";
- Ser. No. 09/074,133, "CLOSE PROP AND LATCH ASSEMBLY FOR STORED ENERGY OPERATING MECHANISM OF ELECTRICAL SWITCHING APPARATUS";
- Ser. No. 09/074,076, "SNAP ACTING CHARGE/DISCHARGE AND OPEN/CLOSED INDICATORS DISPLAYING STATES OF ELECTRICAL SWITCHING APPARATUS";
- Ser. No. 09/074,234, "ELECTRICAL SWITCHING APPARATUS HAVING ARC RUNNER INTEGRAL WITH STATIONARY ARCING CONTACT"; and
- Ser. No. 09/074,052, "DISENGAGEABLE CHARGING MECHANISM FOR SPRING POWERED ELECTRICAL SWITCHING APPARATUS"

BACKGROUND OF THE INVENTION

1. Field of the Invention

This invention relates to electrical switching apparatus such as protective devices and switches used in electric power distribution circuits carrying large currents. More particularly, it relates to such apparatus which uses a large compression spring for closing, and to a clutch assembly for controlling the discharge of energy in the close spring.

2. Background Information

Electrical switching apparatus for opening and closing electric power circuits typically utilize an energy storage device in the form of one or more large springs to close the contacts of the device into the large currents which can be drawn in such circuits. Such electrical switching apparatus includes power circuit breakers and network protectors which provide protection, and electric switches which are used to energize and deenergize parts of the circuit or to transfer between alternative power sources. These devices also include an open spring or springs which rapidly separate the contacts to interrupt current flowing in the power circuit. As indicated, either or both of the close spring and open spring can be a single spring or multiple springs and should be considered as either even though the singular is hereafter used for convenience. The open spring is charged during closing by the close spring which, therefore, must store sufficient energy to both over come the mechanical and magnetic forces for closing as well as charging the open springs. Moreover, the closing spring is required to have sufficient energy to close and latch on at least 15 times the rated current.

Both tension springs and compression springs have been utilized to store sufficient energy to close the contacts and to charge the open spring. The tension springs are easier to control, but the compression springs can store more energy. In either case, a robust operating mechanism is required to mount and control the charging and discharging of the spring. The operating mechanism typically includes a manual handle, and often an electric motor, for charging the close spring. It also includes a latch mechanism for latching the close spring in the charged state, a release mechanism for releasing the stored energy in the close spring, and an arrangement, a pole shaft for example, for coupling the released energy into the moving conductor assembly supporting the moving contacts of the switch.

Because the closing spring is designed to function at 15 times the rated current, it is possible that, when closing on a moderate current, the spring will release enough energy to over-rotate the cam shaft. When the cam is over-rotated a small amount of energy is transferred back into the spring. At this point energy in the spring will cause the cam shaft to reverse and turn backward past the contact closed position. When this happens, the breaker contacts begin to reopen which may cause damage from arcing. The cam may continue to rotate and counter-rotate until equilibrium is reached.

Thus, there is room for improvement in electrical switching apparatus of the above types and particularly in the operating mechanism which controls the discharge of the close spring.

Particularly, there is a need for a simple one-way clutch assembly for the operating mechanism of such apparatus which prevents, reverse rotation following discharge of the close spring.

There is yet another need for such an operating mechanism which is easy and economical to manufacture and assemble.

SUMMARY OF THE INVENTION

These needs and others are satisfied by the invention which is directed to an operating mechanism and electrical switching apparatus incorporating a simple one-way wrap spring clutch assembly. The operating mechanism further includes operating members such as a close spring, spring mounting means, a cam assembly and a rocker assembly coupling the close spring and the cam assembly, all positioned between and substantially fully supported by side plates. The clutch assembly includes a wrap spring clutch that allows the operating mechanism to rotate in the intended direction, but will prevent counter-rotation.

The cam member which forms part of the operating mechanism has a charging cam coupled to the close spring and a drive cam coupled to a carrier on which the moveable contacts of the apparatus are mounted. The charging cam has a charging profile configured to store energy in the close spring through application of torque applied by charging means during a first portion of angular rotation of the cam member. A closing profile on the charging cam is configured to rotate the cam member and operate the carrier to a closed position through release of energy stored in the close spring during a second portion of angular rotation of the cam member. This closing profile of the charging cam is configured for a controlled release of the energy stored in the close spring. Preferably, the closing profile of the charging cam is configured for a controlled release of about fifty percent, and preferably between about fifty and sixty percent, of the energy stored in the close spring before closure of the separable contacts.

The ends of the cam shaft project through the side plates. One end of the cam shaft passes through a circular collar which is fixed to the side plate. A rotor is attached to the cam having the same diameter as the collar and which is immediately adjacent to the collar. A helical spring having an inner diameter that is slightly smaller than the collar and rotor is disposed overtop both the collar and spacer ring. A housing is disposed overtop the spring. Because the spring has a smaller diameter than the collar and rotor, the spring acts on the collar and rotor with a radial force. The spring is placed on the cam so that when the cam rotates in the proper direction, the spring is uncoiled and tends to expand. As the spring expands, the radial force is decreased and the cam may rotate almost freely. When rotating in the proper direction, the spring provides a slip-torque of approximately 15 inch-pounds. Although the uncoiling of the spring tends to force the spring off the collar and rotor, the spring is maintained on the collar and rotor by the housing. Conversely, when the cam counter-rotates, the spring tends to coil tighter, causing the spring to constrict on the collar and rotor increasing the radial force. This results in a reverse torque of approximately 2000 inch-pounds. Due to the reverse torque, counter-rotation of the cam is virtually eliminated.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to a power air circuit breaker; however, it also has application to other electrical switching apparatus for opening and closing electric power circuits. For instance, it has application to switches providing a disconnect for branch power circuits and transfer switches used to select alternate power sources for a distribution system. The major difference between a power circuit breaker and these various switches is that the circuit breaker has a trip mechanism which provides overcurrent protection. The invention could also be applied to network protectors which provide protection and isolation for distribution circuits in a specified area.

This application relates to application Ser. No. 09/074,240, which is incorporated by reference. This invention specifically relates to a clutch mechanism to prevent counter rotation of the cam in a power air circuit breaker after discharge of the close spring. Application Ser. No. 09/074,240 provides a full description of the charging mechanism, as well as various other components of the circuit breaker, which are not relevant to the clutch mechanism.

Figure 1:
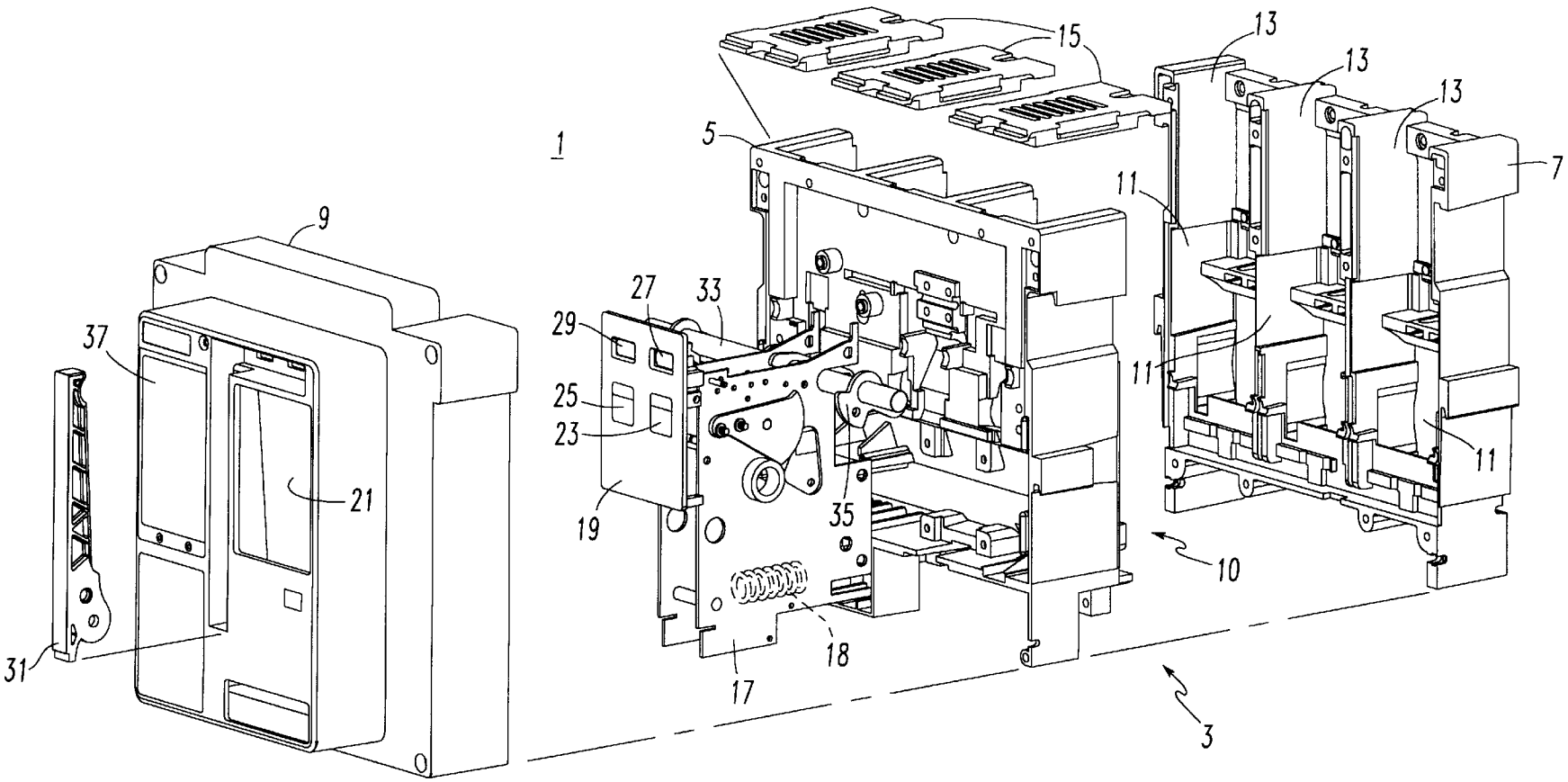
FIG. 1 is an exploded isometric view of a low voltage, high current power circuit breaker in accordance with the invention.

Referring to FIG. 1, the power air circuit breaker 1 of the invention has a housing 3 which includes a molded front casing 5 and a rear casing 7, and a cover 9. The exemplary circuit breaker 1 has three poles 10 with the front and rear casings 5, 7 forming three, pole chambers 11. Each pole 10 has an arc chamber 13 which is enclosed by a ventilated arc chamber cover 15.

Circuit breaker 1 has an operating mechanism 17 which is mounted on the front of the front casing 5 and is enclosed by the cover 9. The operating mechanism 17 has a face plate 19 which is accessible through an opening 21 in the cover. The operating mechanism 17 includes a large close spring 18 which is charged to store energy for closing the circuit breaker. Face plate 19 mounts a push to close button 23 which is actuated to discharge the close spring for closing the circuit breaker, and a push to open button 25 for opening the circuit breaker. Indicators 27 and 29 display the condition of the close spring and the open/closed state of the contacts, respectively. The close spring 18 is charged by operation of the charging handle 31 or remotely by a motor operator (not shown).

The common operating mechanism 17 is connected to the individual poles by a pole shaft 33 with a lobe 35 for each pole. As is conventional, the circuit breaker 1 includes an electronic trip unit 37 supported in the cover 9 which actuates the operating mechanism 17 to open all of the poles 10 of the circuit breaker through rotation of the pole shaft 33 in response to predetermined characteristics of the current flowing through the circuit breaker.

Figure 2:
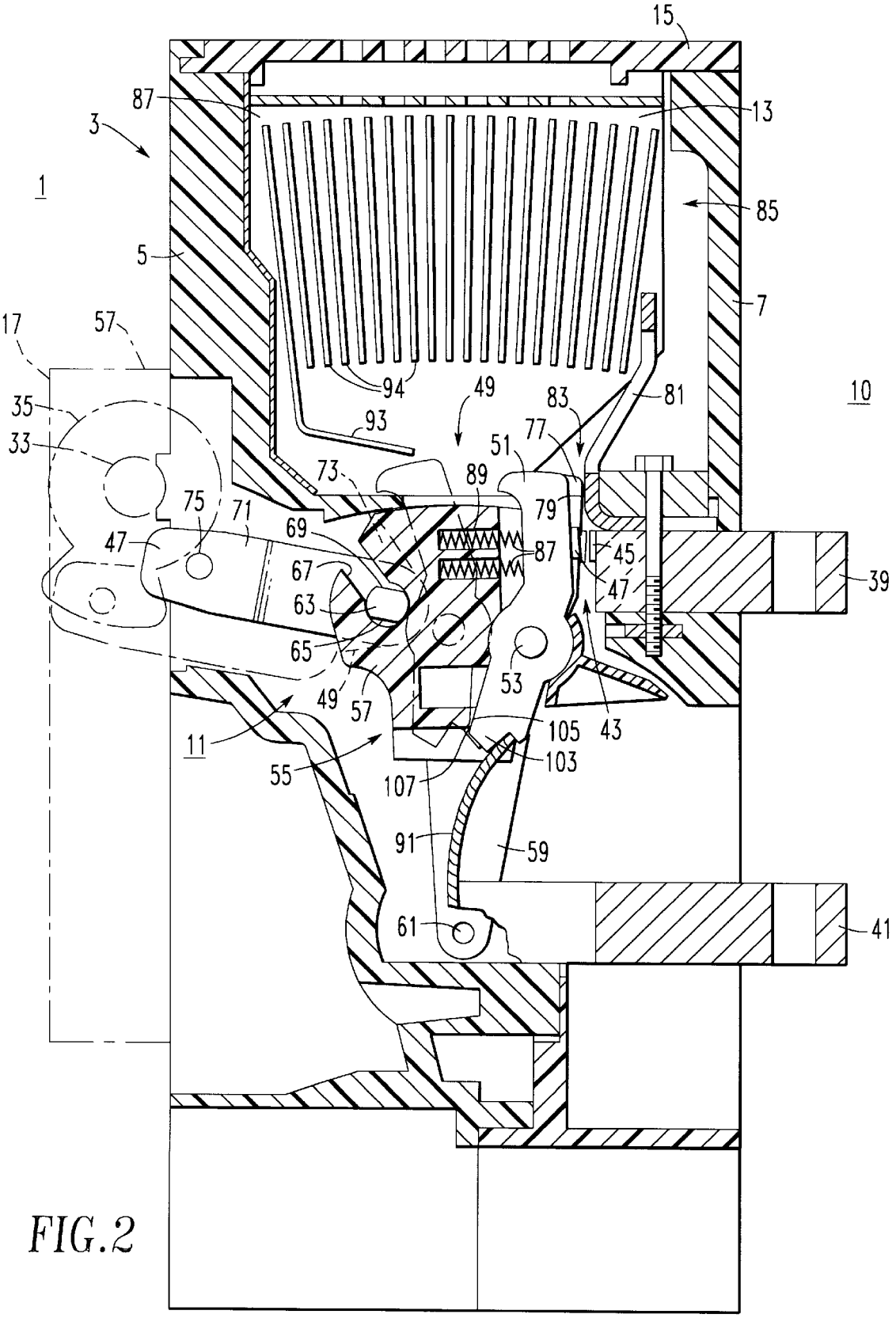
FIG. 2 is a vertical section through a pole of the circuit breaker of FIG. 1 shown as the contacts separate during opening.

FIG. 2 is a vertical section through one of the pole chambers. The pole 10 includes a line side conductor 39 which projects out of the rear casing 7 for connection to a source of ac electric power (not shown). A load conductor 41 also projects out of the rear casing 7 for connection typically to the conductors of the load network (also not shown).

Each pole 10 also includes a pair of main contacts 43 that include a stationary main contact 45 and a moveable main contact 47. The moveable main contact 47 is carried by a moving conductor assembly 49. This moving conductor assembly 49 includes a plurality of contact fingers 51 which are mounted in spaced axial relation on a pivot pin 53 secured in a contact carrier 55. The contact carrier 55 has a molded body 57 and a pair of legs 59 (only one shown) having pivots 61 rotatably supported in the housing 3.

The contact carrier 55 is rotated about the pivots 61 by the drive mechanism 17 which includes a drive pin 63 received in a transverse passage 65 in the carrier body 57 through a slot 67 to which the drive pin 63 is keyed by flats 69. The drive pin 63 is fixed on a drive link 71 which is received in a groove 73 in the carrier body. The other end of the drive link is pivotally connected by a pin 75 to the associated pole arm 35 on the pole shaft 33 similarly connected to the carriers (not shown) in the other poles of the circuit breaker. The pole shaft 33 is rotated by the operating mechanism 17.

A moving main contact 47 is fixed to each of the contact fingers 51 at a point spaced from the free end of the finger. The portion of the contact finger adjacent the free end forms a moving arcing contact or "arc toe" 77. A stationary arcing contact 79 is provided on the confronting face of an integral arcing contact and runner 81 mounted on the line side conductor 39. The stationary arcing contact 79 and arc toe 77 together form a pair of arcing contacts 83. The integral arcing contact and runner 81 extends upward toward a conventional arc chute 85 mounted in the arc chamber 13.

The contact fingers 51 are biased clockwise as seen in FIG. 2 on the pivot pin 53 of the carrier 55 by pairs of helical compression springs 87 seated in recesses 89 in the carrier body 55. The operating mechanism 17 rotates the pole shaft 33 which in turn pivots the contact carrier 55 clockwise to a closed position (not shown) to close the main contacts 43. To open the contacts, the operating mechanism 17 releases the pole shaft 33 and the compressed springs 87 accelerate the carrier 55 in a counterclockwise direction to an open position (not shown). As the carrier is rotated clockwise toward the closed position, the arc toes 77 contact the stationary arcing contacts 79 first. As the carrier continues to move clockwise, the springs 87 compress as the contact fingers 51 rock about the pivot pin 53 until the main contacts 43 close. Further clockwise rotation to the fully closed position (not shown) results in opening of the arcing contacts 83 while the main contacts 43 remain closed. In that closed position, a circuit is completed from the line conductor 39 through the closed main contacts 43, the contact fingers 51, flexible shunts 91, and the load conductor 41.

To open the circuit breaker 1, the operating mechanism 17 releases the pole shaft 33 so that the compressed springs 87 accelerate the carrier 55 counterclockwise as viewed in FIG. 2. Initially, as the carrier 55 moves away from the line conductor 39, the contact fingers 51 rock so that the arcing contacts 83 close while the main contacts 43 remain closed. As the carrier 55 continues to move counterclockwise, the main contacts 43 open and all of the current is transferred to the arcing contacts 83 which is the condition shown in FIG. 2. If there is a sizeable current being carried by the circuit breaker such as when the circuit breaker trips open in response to an overcurrent or short circuit, an arc is struck between the stationary arcing contacts 79 and the moveable arcing contacts or arc toes 77 as these contacts separate with continued counterclockwise rotation of the carrier 55. As the main contacts 43 have already separated, the arcing is confined to the arcing contacts 83 which preserves the life of the main contacts 43. The electromagnetic forces produced by the current sustained in the arc push the arc outward toward the arc chute 85 so that the end of the arc at the stationary arc contact 79 moves up the integral arcing contact and runner 81 and into the arc chute 85. At the same time, the rapid opening of the carrier 55 brings the arc toes 77 adjacent the free end of the arc top plate 93 as shown in phantom in FIG. 2 so that the arc extends from the arc toes 77 to the arc top plate 93 and moves up the arc top plate into the arc plates 94 which break the arc up into shorter sections which are then extinguished.

Figure 3:
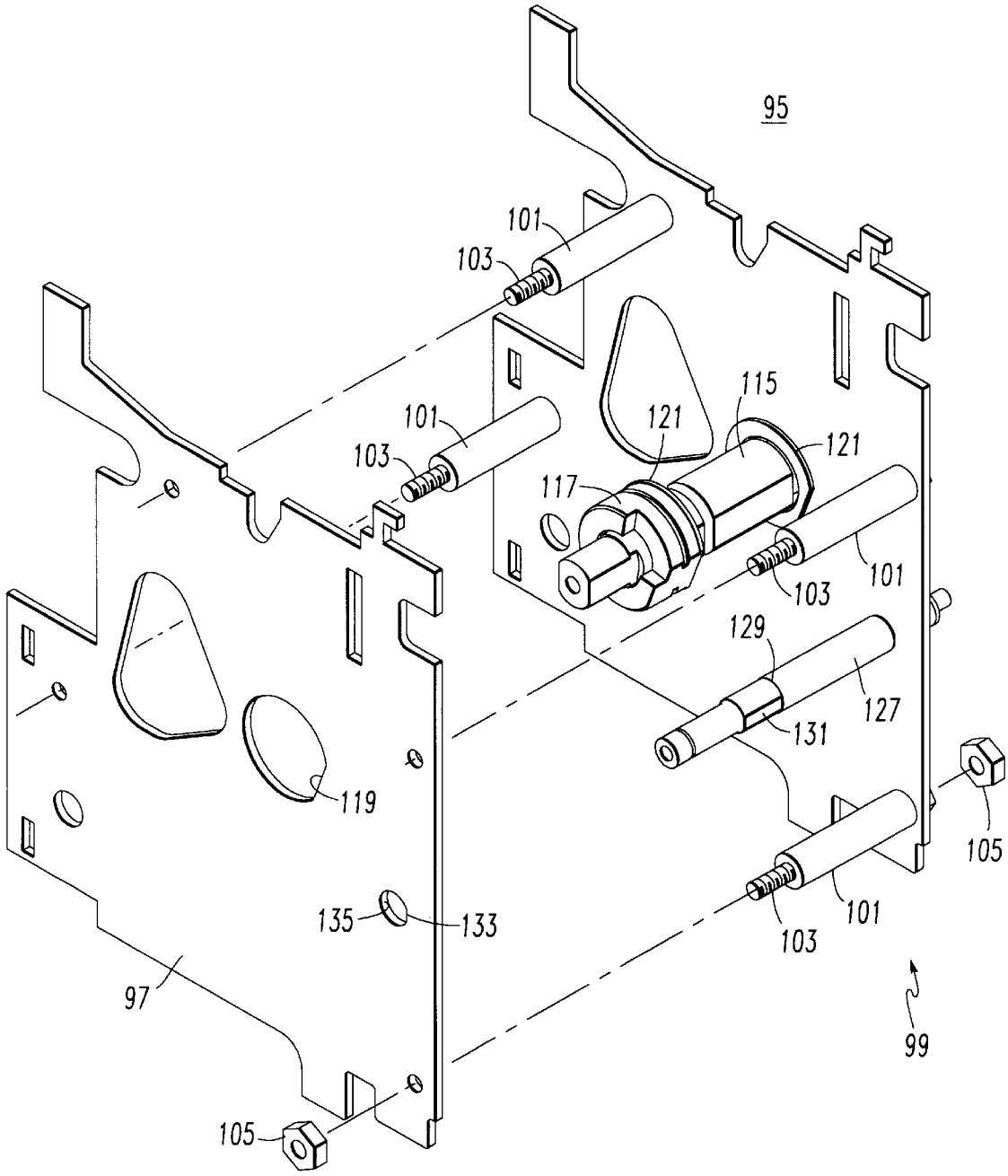
FIG. 3 is an exploded isometric view of a cage assembly which forms part of the operating mechanism of the circuit.
Figure 4:
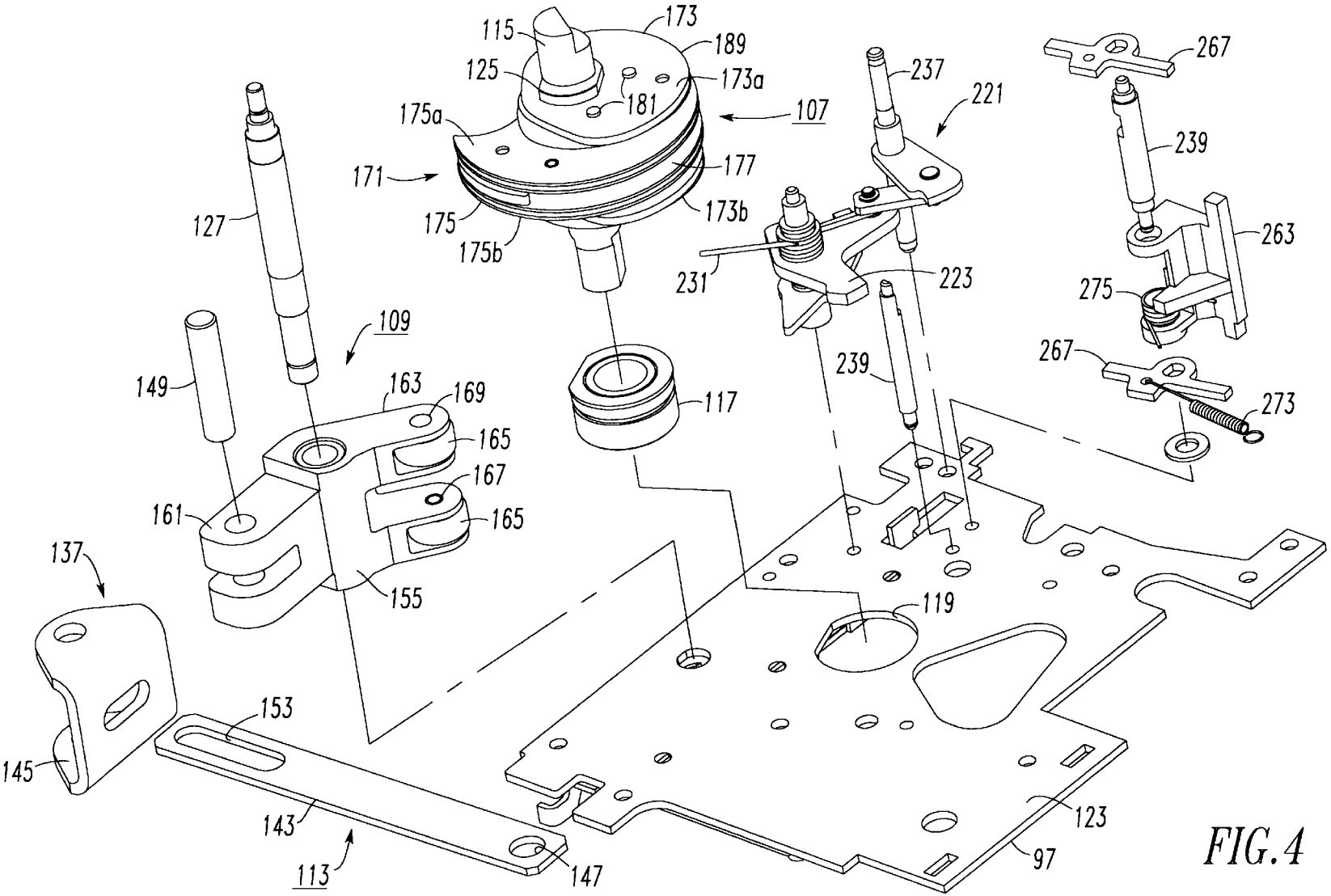
FIG. 4 is an exploded isometric view illustrating assembly of the operating mechanism.
Figure 5:
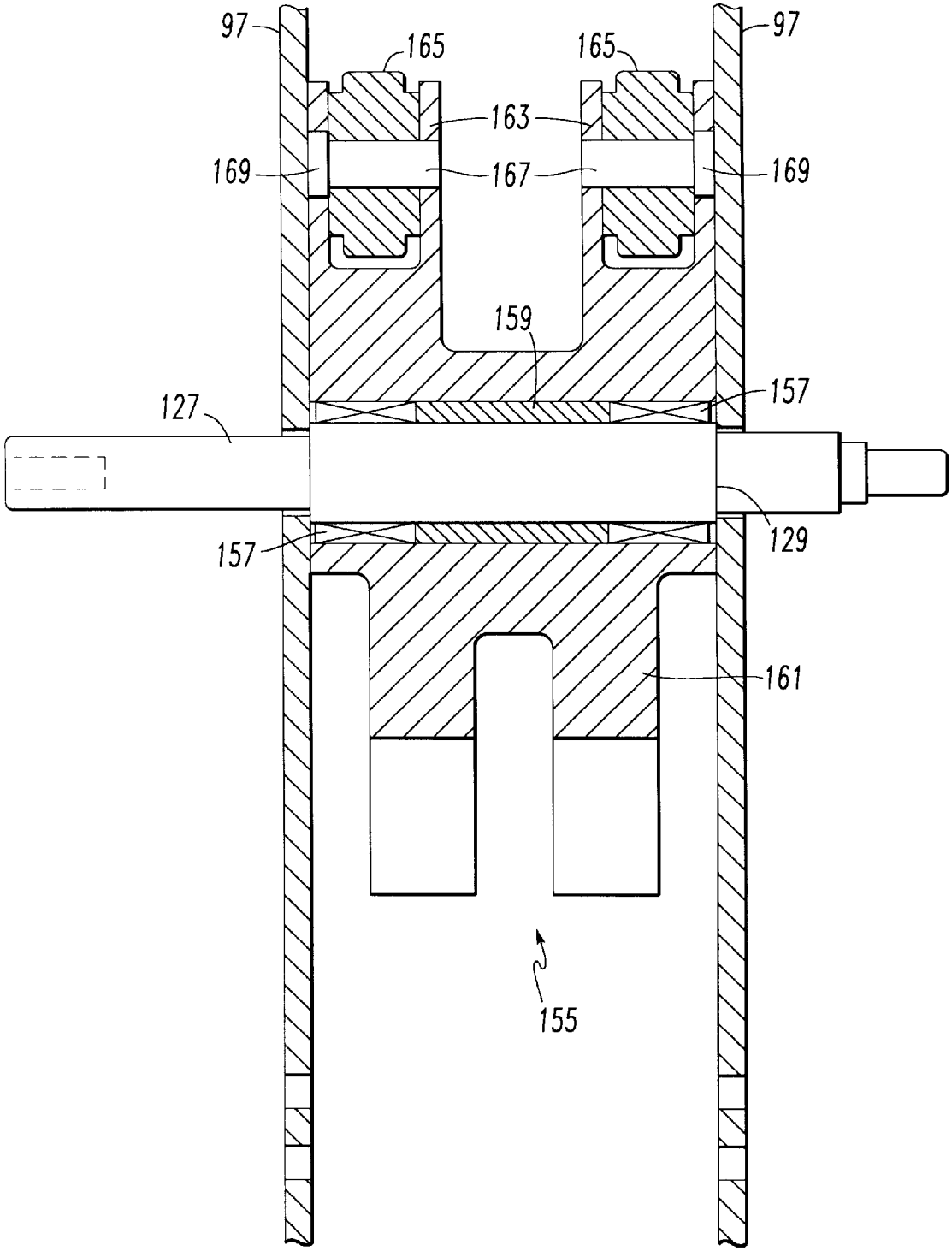
FIG. 5 is a partial vertical sectional view through an assembled operating mechanism taken through the rocker assembly.

The operating mechanism 17 is a self supporting module having a cage 95. As shown in FIG. 3, the cage 95 includes two side plates 97 which are identical and interchangeable. The side plates 97 are held in spaced relation by four elongated members 99 formed by spacer sleeves 101, and threaded shafts 103 and nuts 105 which clamp the side plates 97 against the spacer sleeves 101. Four major subassemblies and a large close spring 18 make up the power portion of the operating mechanism 17. The four major subassemblies are the cam assembly 107, the rocker assembly 109, the main link assembly 111 and a close spring support assembly 113. All of these components fit between the two side plates 97. Referring to FIGS. 3 and 4, the cam assembly 107 includes a cam shaft 115 which is journaled in a non-cylindrical bushing 117 seated and a spring clutch collar 222 (See FIG. 12) which are seated in complementary non-cylindrical openings 119 in the side plates 97. The bushing 117 has a flange 121 which bears against the inner face 123 of the side plate 97 and the cam shaft 115 has shoulders 125 which position it between the bushing 117 and the collar 222 so that the cam shaft 115 and the bushing 117 are captured between the side plates 97 without the need for fasteners. Similarly, a rocker pin 127 of the rocker assembly 109 has shoulders 129 which capture it between the side plates as seen in FIGS. 3–5. Flats 131 on the rocker pin 127 engages similar flats 133 in openings 135 in the side plates 97 to prevent rotation of the rocker pin. The cam shaft 115 and rocker pin 127 add stability to the cage 95 which is self-aligning and needs no special fixturing for alignment of the parts during assembly. As the major components are "sandwiched"0 between the two side plates 97, the majority of the components need no additional hardware for support. As will be seen, this sandwich construction simplifies assembly of the operating mechanism 17.

Figure 6:
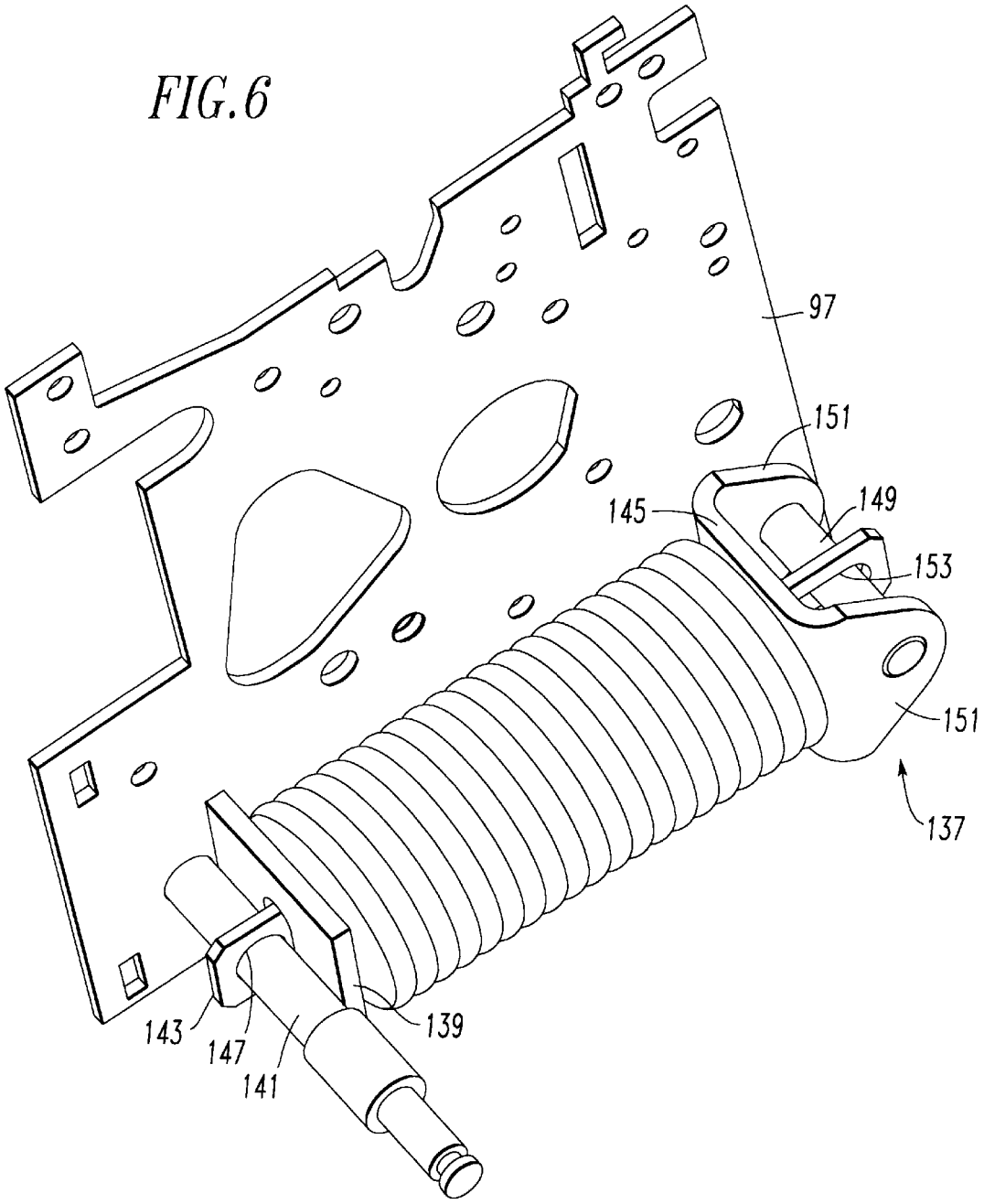
FIG. 6 is an isometric view illustrating the mounting of the close spring which forms part of the operating mechanism.
Figure 7:
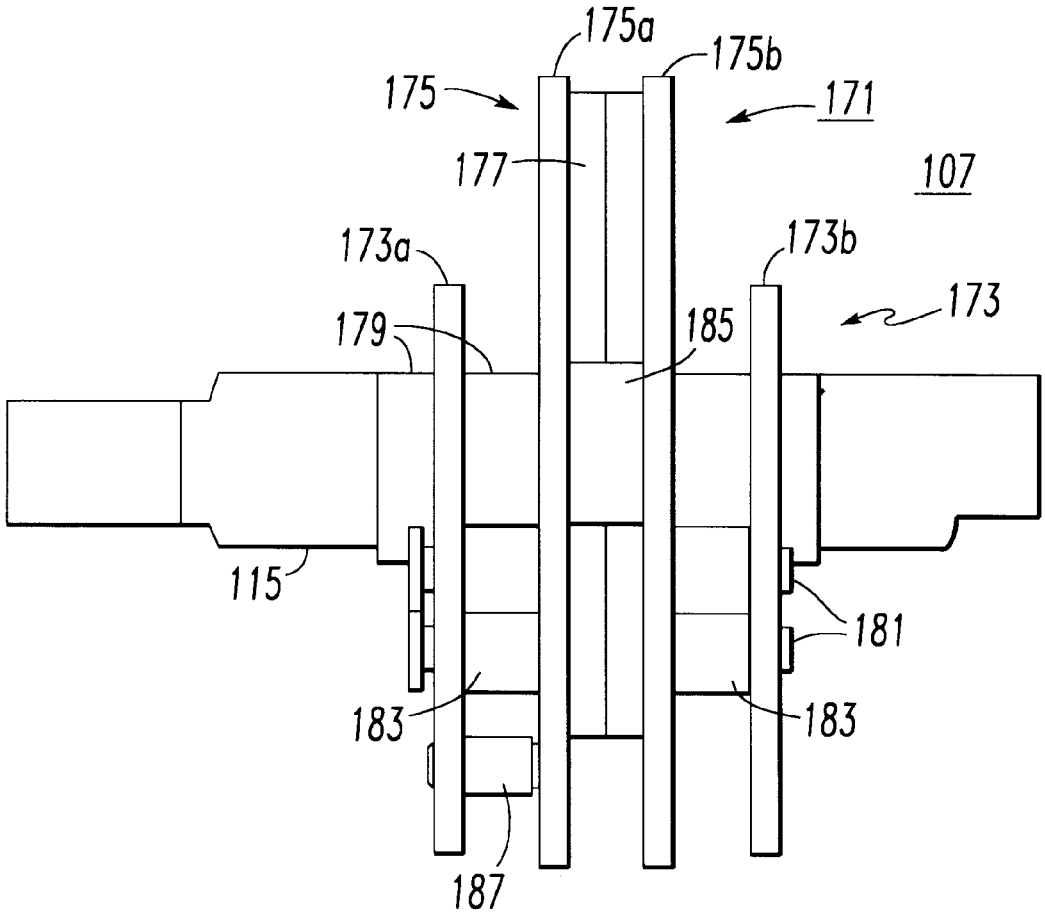
FIG. 7 is a side elevation view of the cam assembly which forms part of the operating mechanism.

The close spring 18 is a common, round wire, heavy duty, helical compression spring closed and ground flat on both ends. A compression spring is used because of its higher energy density than a tension spring. The helical compression close spring 18 is supported in a very unique way by the close spring support assembly 113 in order to prevent stress risers and/or buckling. In such a high energy application, it is important that the ends of the close spring 18 be maintained parallel and uniformly supported and that the spring be laterally held in place. As illustrated particularly in FIGS. 4 and 6, and also in FIGS. 8–11, this is accomplished by compressing the helical compression close spring 18 between a U bracket 137 which is free to rotate and also drive the rocker assembly 109 at one end, and a nearly square spring washer or guide plate 139 which can pivot against a spring stop or support pin 141 which extends between the slide plates 97 at the other end. The close spring 18 is kept from "walking" as it is captured between the two side plates 97, and is laterally restrained by an elongated guide member 143 that extends through the middle of the spring, the spring washer 139 and the brace 145 of the U bracket 137. The elongated guide member 143 in turn is captured on one end by the spring stop pin 141 which extends through an aperture 147, and on the other end by a bracket pin 149 which extends through legs 151 on the U bracket 137 and an elongated slot 153 in the elongated member.

The rocker assembly 109 includes a rocker 155 pivotally mounted on the rocker pin 127 by a pair of roller bearings 157 which are captured between the side plates 97 and held in spaced relation by a sleeve 159 as best seen in FIG. 5. The rocker 155 has a clevis 161 on one end which pivotally connects the rocker 155 to the U bracket 137 through the bracket pin 149. A pair of legs 163 on the other end of the rocker 155 which extend at an obtuse angle to the clevis 161, form a pair of roller clevises which support rocker rollers 165. The rocker rollers 165 are pivotally mounted to the roller clevises by pins 167. These pins 167 have heads 169 facing outwardly toward the side plates 97 so that they are captured and retained in place without the need for any snap rings or other separate retainers. As the rocker 155 rocks about the rocker pin 127, the spring washer 139 rotates on the spring support shaft 141 so that the loading on the close spring 18 remains uniform regardless of the position of the rocker 155. The close spring 18, spring washer 139 and spring support pin 141 are the last items that go into a finished mechanism 17 so that the close spring 18 can be properly sized for the application.

The U bracket pin 149 transfers all of the spring loads and energy to the rocker clevis 161 on the rocker 155. The translational loads on the rocker 155 are transferred into the non-rotating rocker pin 127 and from there into the two side plates 97 while the rocker 155 remains free to rotate between the plates 97.

Referring to FIGS. 4–11, the cam assembly 107 includes in addition to the cam shaft 115, a cam member 171. The cam member 171 includes a charge cam 173 formed by a pair of charge cam plates 173*a*, 173*b* mounted on the cam shaft 115. The charge cam plates 173*a*, 173*b* straddle a drive cam 175 which is formed by a second pair of cam plates 175*a*, 175*b*. A cam spacer 177 sets the spacing between the drive cam plates 175*a*, 175*b* while spacer bushings 179 separate the charge cam plates 173*a*, 173*b* from the drive cam plates and from the side plates 97. The cam plates 173, 175 are all secured together by rivets 181 extending through rivet spacers 183 between the plates. A stop roller 185 is pivotally mounted between the drive cam plates 175*a* and 175*b* and a reset pin 187 extends between the drive cam plate 175*a* and the charge cam plate 173*a*. The cam assembly 107 is a 360° mechanism which compresses the close spring 18 to store energy during part of the rotation, and which is rotated by release of the energy stored in the close spring 18 during the remainder of rotation. This is accomplished through engagement of the charge cam plates 173*a*, 173*b* by the rocker rollers 165. The preload on the close spring 18 maintains the rocker rollers 165 in engagement with the charge cam plates 173*a*, 173*b*. The charge cam 173 has a cam profile 189 with a charging portion 189*a* which at the point of engagement with the rocker rollers 165 increases in diameter with clockwise rotation of the cam member 171. The cam shaft 115 and therefore the cam member 171 is rotated either manually by the handle 31 or by an electric motor (not shown). The charging portion 189*a* of the charge cam profile 189 is configured so that a substantially constant torque is required to compress the close spring 18. This provides a better feel for manual charging and reduces the size of the motor required for automatic charging as the constant torque is below the peak torque which would normally be required as the spring approaches the fully compressed condition.

The cam profile 189 on the charge cam 173 also includes a closing portion 189*b* which decreases in diameter as the charge cam 173 rotates against the rocker rollers 165 so that the energy stored in the close spring 18 drives the cam member 171 clockwise when the mechanism is released.

The drive cam 175 of the cam member 171 has a cam profile 191 which in certain rotational positions is engaged by a drive roller 193 mounted on a main link 195 of the main link assembly 111 by a roller pin 197. The other end of the main link 195 is pivotally connected to a drive arm 199 on the pole shaft 33 by a pin 201. This main link assembly 111 is coupled to the drive cam 175 for closing the circuit breaker 1 by a trip mechanism 203 which includes a hatchet plate 205 pivotally mounted on a hatchet pin 207 supported by the side plates 97 and biased counterclockwise by a spring 219. A banana link 209 is pivotally connected at one end to an extension on the roller pin 197 of the main link assembly and at the other end is pivotally connected to one end of the hatchet plate 205. The other end of the hatchet plate 205 has a latch ledge 211 which engages a trip D shaft 213 when the shaft is rotated to a latch position. With the hatchet plate 205 latched, the banana link 209 holds the drive roller 193 in engagement with the drive cam 175. In operation, when the trip D shaft 213 is rotated to a trip position, the latch ledge 211 slides off of the trip D shaft 213 and the hatchet plate 205 passes through a notch 215 in the trip D shaft which repositions the pivot point of the banana link 209 connected to the hatchet plate 205 and allows the drive roller 193 to float independently of the drive cam 175.

Figure 8:
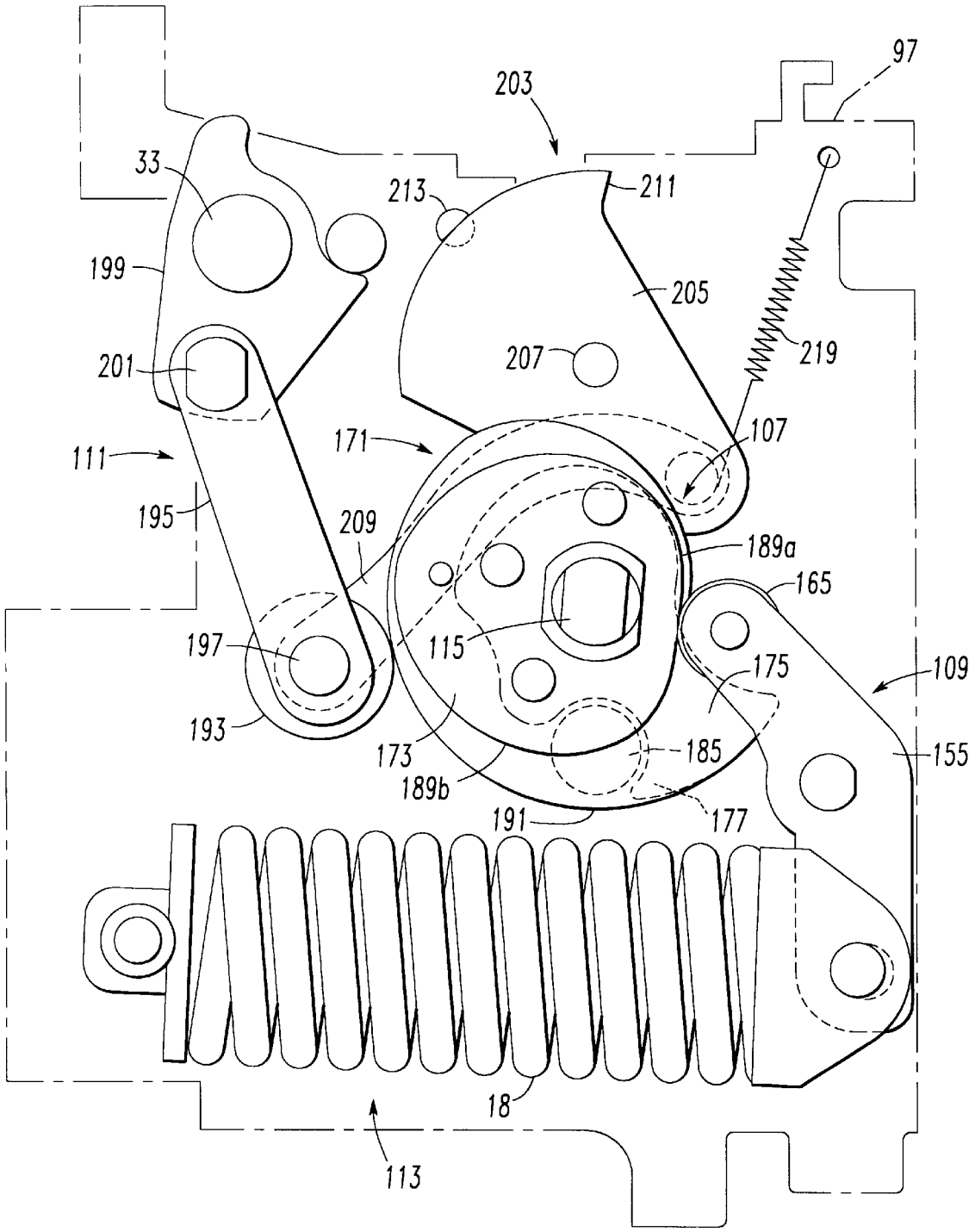
FIG. 8 is an elevation view illustrating the relationship of the major components of the operating mechanism shown with the contacts open and the close spring discharged.
Figure 9:
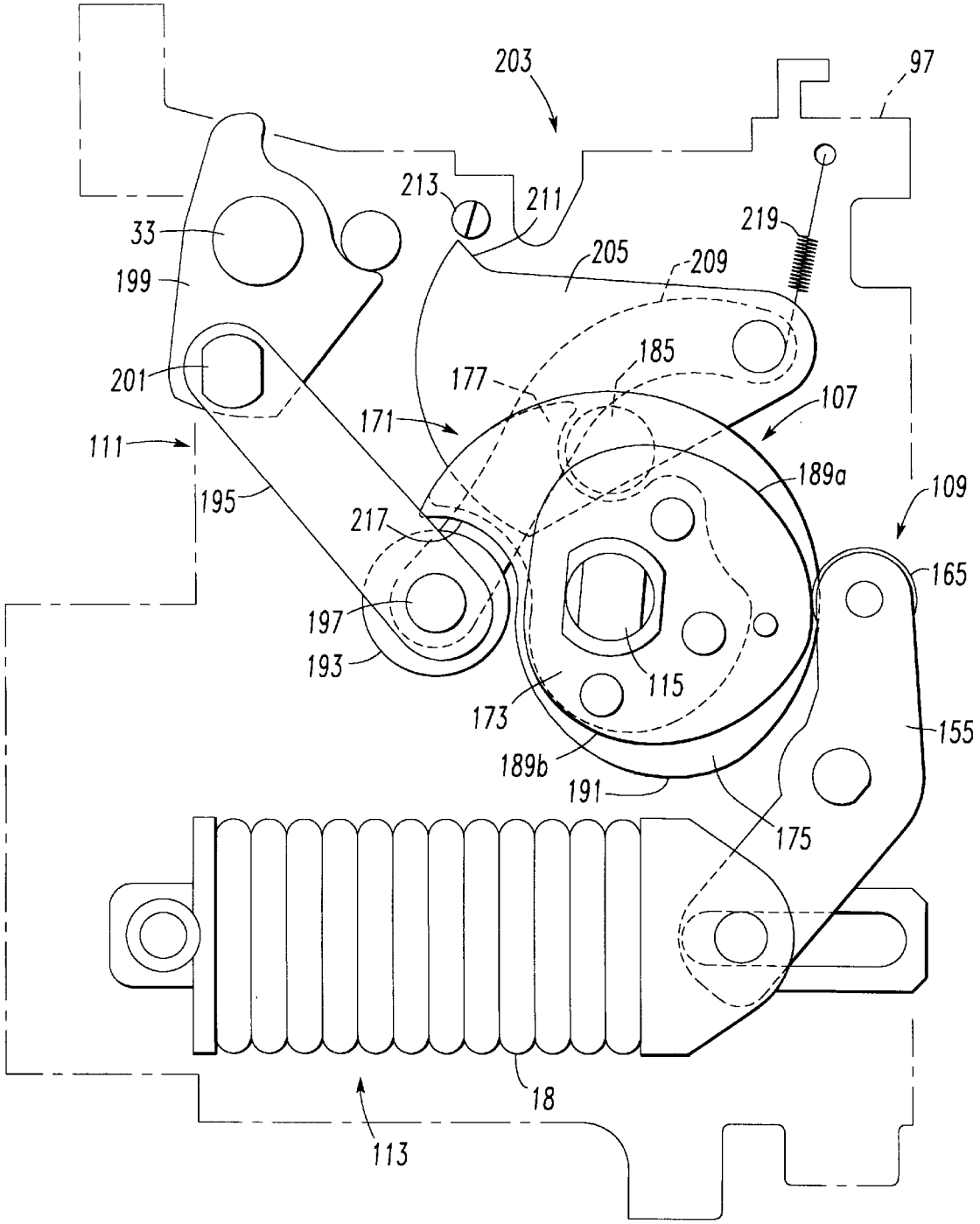
FIG. 9 is a view similar to FIG. 8 shown with the contacts open and the close spring charged.
Figure 10:
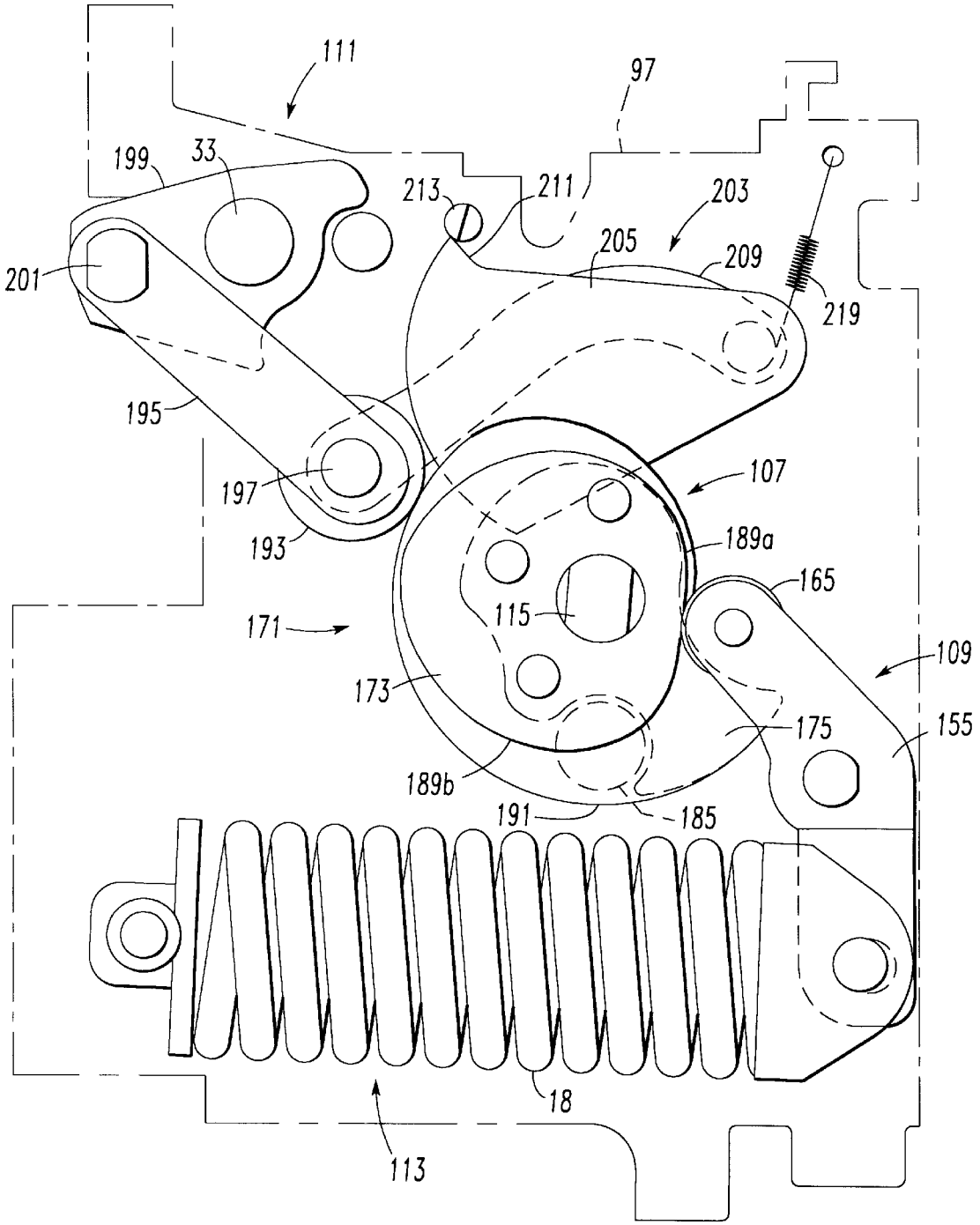
FIG. 10 is a view similar to FIG. 8 shown with the contacts closed and the close spring discharged.

The sequence of charging and discharging the close spring 18 can be understood by reference to FIGS. 8–11. It should be understood that there are two conditions for two components; the close spring 18 which may be charged or discharged, and the contacts 43 which may be open or closed. Thus, FIGS. 8–11 show the four combinations of these conditions. That is, in FIG. 8, the contacts 43 (not shown) are in the open position and the close spring 18 is discharged. In FIG. 9, the close spring 18 is charged and the contacts 43 (not shown) remain open. In FIG. 10, the close spring 18 has been discharged to close the contacts 43 (not shown). Finally, in FIG. 11, the contacts 43 (not shown) remain closed and the close spring 18 has been charged. The spring clutch assembly 220, described below, prevents counter rotation of cam shaft 115 following the discharge of the close spring 18. A detailed description of the sequence to charge the close spring 18, close the contacts 43, and charge the close spring 18 again follows.

In FIG. 8 the mechanism is shown in the discharged open position, that is, the close spring 18 is discharged and the contacts 43 are open. It can be seen that the cam member 171 is positioned so that the charge cam 173 has its smallest radius in contact with the rocker rollers 165. Thus, the rocker 155 is rotated to a full counterclockwise position and the close spring 18 is at its maximum extension. It can also be seen that the trip mechanism 203 is not latched so that the drive roller 193 is floating although resting against the drive cam 175. As the cam shaft 115 is rotated clockwise manually by the handle 31 or through operation of the charge motor (not shown) the charge portion 189*a* of the charge profile on the charge cam which progressively increases in diameter, engages the rocker roller 165 and rotates the rocker 155 clockwise to compress the spring 18. As mentioned, the configuration of this charge portion 189*a* of the profile is selected so that a constant torque is required to compress the spring 18. During this charging of the close spring 18, the driver roller 193 is in contact with a portion of the drive cam profile 191 which has a constant radius so that the drive roller 193 continues to float.

Moving now to FIG. 9, as the close spring 18 becomes fully charged, the drive roller 193 falls off of the drive cam profile 191 into a recess 217. This permits the reset spring 219 to rotate the hatchet plate 205 counterclockwise until the latch ledge 211 passes slightly beyond the trip D shaft 213. This raises the pivot point of the banana link 209 on the hatchet plate 205 so that the drive roller 193 is raised to a position where it rests beneath the notch 217 in the drive cam 175. At the same time, the rocker rollers 165 reach a point just after 170° rotation of the cam member where they enter the close portion 189*b* of the charge cam profile 189. On this portion 189*b* of the charge cam profile, the radius of the charge cam 173 in contact with the rocker rollers 165 decreases in radius with clockwise rotation of the cam member 171. Thus, the close spring 18 applies a force tending to continue rotation of the cam member 171 in the clockwise direction. However, a close prop (not shown in FIG. 9) which is part of a close prop mechanism, described fully in application Ser. No. 09/074,240, engages the stop roller 185 and prevents further rotation of the cam member 171. Thus, the close spring 18 remains fully charged ready to close the contacts 43 of the circuit breaker 1.

The contacts 43 of the circuit breaker 1 are closed by release of the close prop. With the close prop disengaged from the stop roller 185, the spring energy is released to rapidly rotate the cam member 171 to the position shown in FIG. 10. As the cam member 171 rotates, the drive roller 193 is engaged by the cam profile 191 of the drive cam 175. The radius of this cam profile 191 increases with cam shaft rotation and since the banana link 209 holds the drive roller 193 in contact with this surface, the pole shaft 33 is rotated to close the contacts 43 as described in connection with FIG. 2. At this point the latch ledge 211 engages the D latch 213 and the contacts are latched closed. If the circuit breaker is tripped at this point by rotation of the trip D shaft 213 so that this latch ledge 211 is disengaged from the D shaft 213, the very large force generated by the compressed contact springs 87 (see FIG. 2) exerted through the main link 195 pulls the pivot point of the banana link 209 on the hatchet plate 205 clockwise downward as the hatchet plate rotates about the hatchet pin 207 (See FIG. 8) and the drive roller 193 drops free of the drive cam 175 allowing the pole shaft 33 to rotate and the contacts 43 to open. With the contacts 43 open and the close spring 18 discharged the mechanism would again be in the state shown in FIG. 8.

Figure 11:
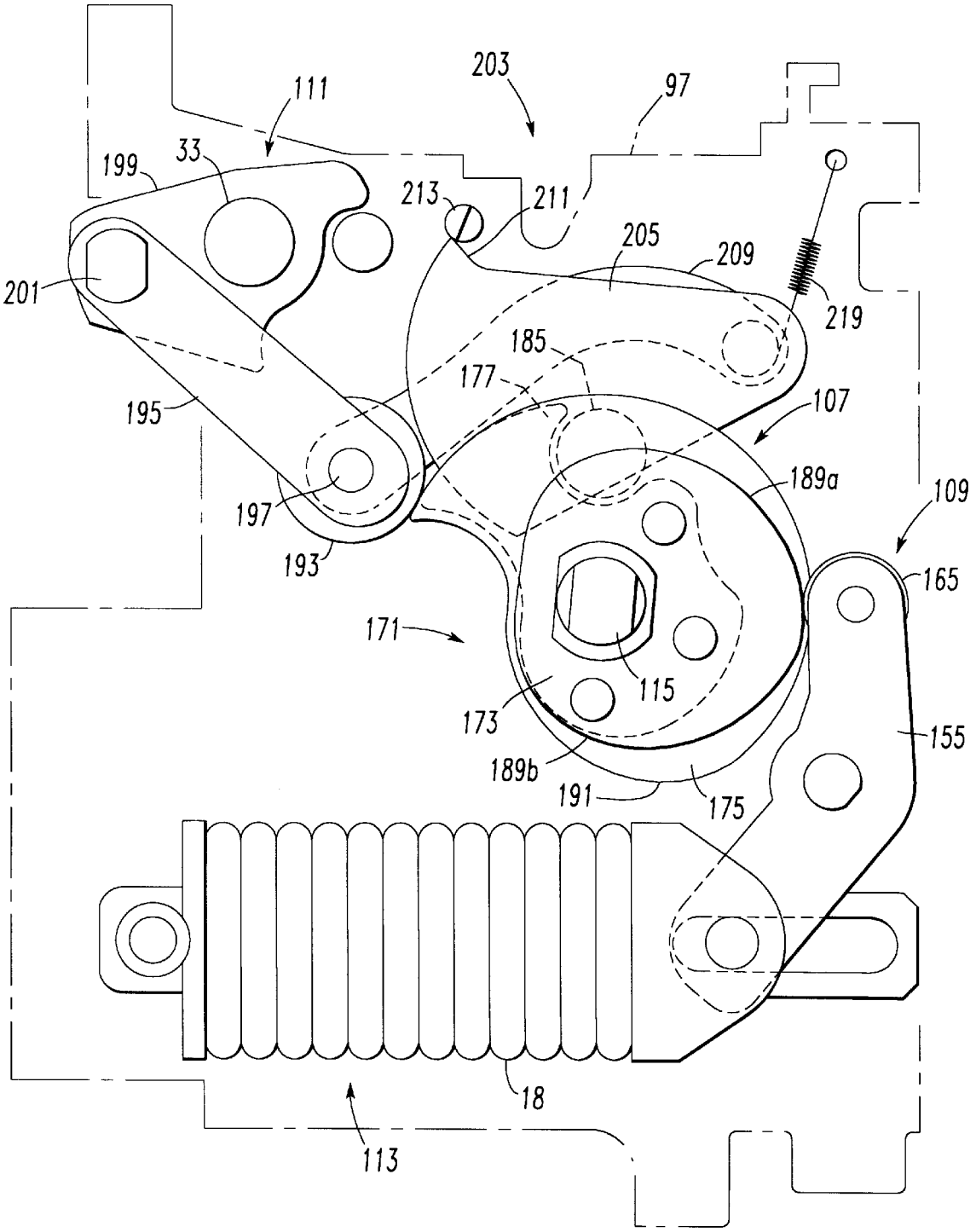
FIG. 11 is a view similar to FIG. 8 shown with the contacts closed and the close spring charged.

Typically, when the circuit breaker is closed, the close spring 18 is recharged, again by rotation of the cam shaft 115 either manually or electrically. This causes the cam member 171 to return to the same position as in FIG. 9, but with the trip mechanism 203 latched, the banana link 209 keeps the drive roller 193 engaged with the drive profile 191 on the drive cam 175 as shown in FIG. 11. If the circuit breaker is tripped at this point by rotation of the trip D latch 213 so that the hatchet plate 205 rotates clockwise, the drive roller 193 will drop down into the notch 217 in the drive cam 175 and the circuit breaker will open.

Figure 12:
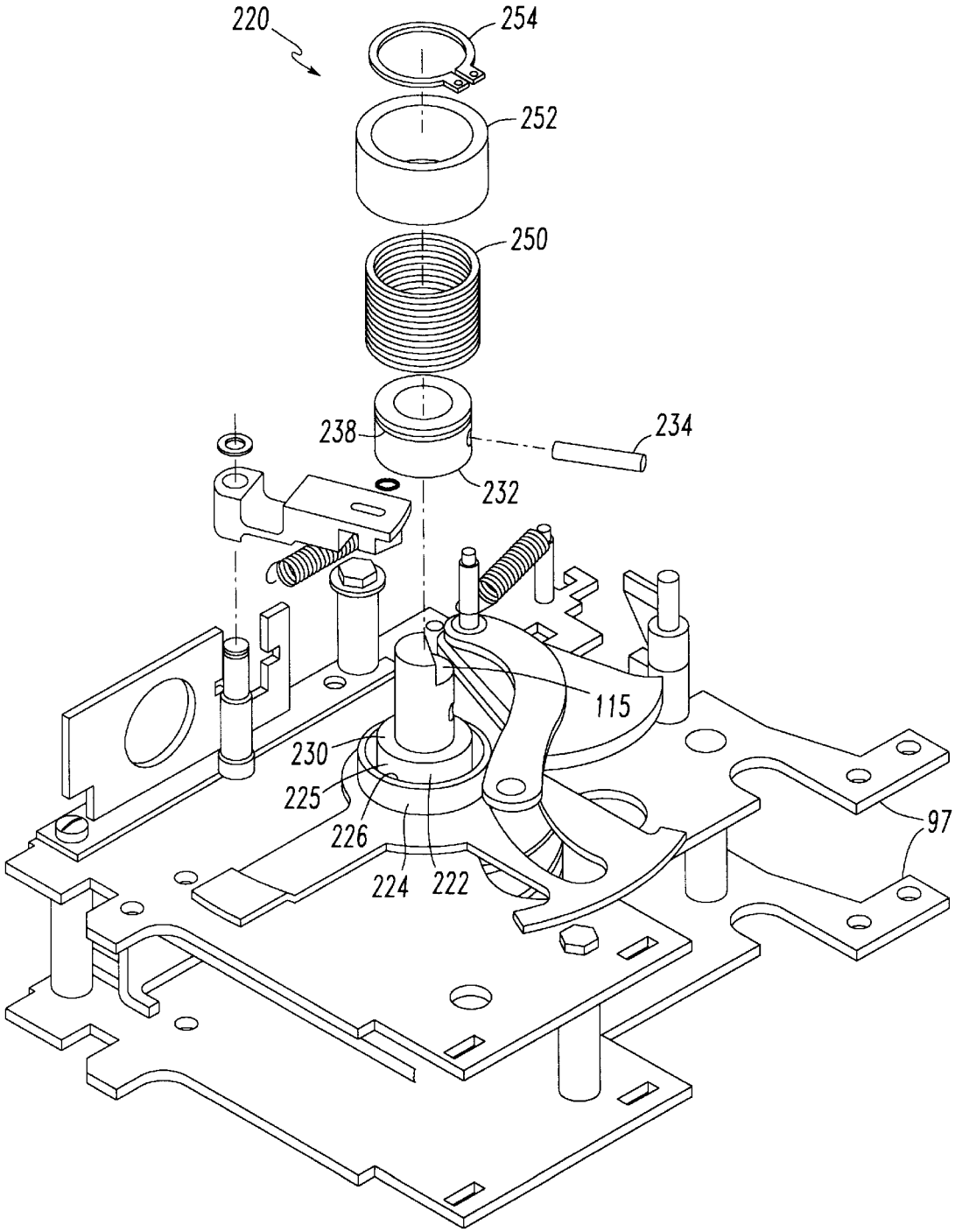
FIG. 12 is an exploded view of the spring clutch assembly.
Figure 13:
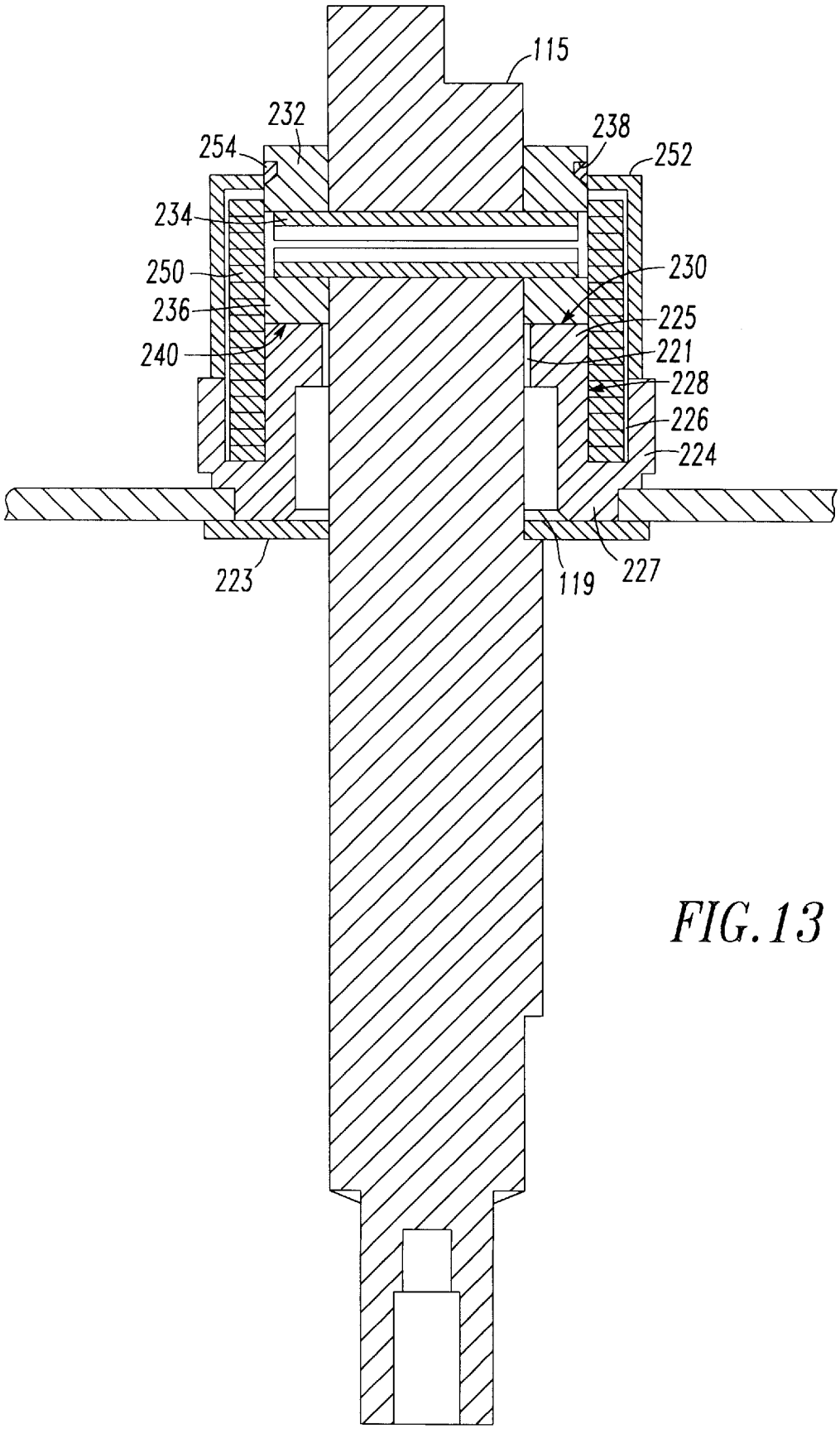
FIG. 13 is a cross-sectional view of the spring clutch assembly.

As shown in FIGS. 12 and 13, a one-way wrap spring clutch assembly 220 is disposed about the cam shaft 115. In the preferred embodiment, the spring clutch assembly 220 is disposed about an end of the cam shaft 115 that projects through side plate 97, however, the spring clutch 220 may placed at any location on the cam shaft 115. A fixed member, preferably shaped as circular collar, 222 is attached to plate 97 disposed about non-cylindrical opening 119 in plate 97. Alternatively, the collar 222 may be integrated with a non-cylindrical bushing 117 which is disposed within the non-cylindrical opening 119 in plate 97. A washer 223 is disposed about non-cylindrical opening 119 in plate 97 on the side of plate 97 opposite collar 222.

The collar 222 has a medial opening 221 which allows the cam shaft 115 to pass therethrough. The collar 222 has a U-shaped cross section wherein the outer portion of the collar forms an outer ring 224 and the inner portion of the collar forms an inner ring 225. The outer surface of the inner ring 225 forms a spring bearing surface 228 having a constant diameter. The outer ring 224 and the inner ring 225 are joined by a base 227. Between the outer ring 224 and the inner ring 225 is an annular axial facing channel 226. Perpendicular to the spring bearing surface 228 is a rotor bearing surface 230, which abuts the rotor 232 described below. A cylindrical rotor 232 is attached by rotor pin 234 to cam shaft 115. Rotor 232 has a collar bearing surface 240, a circumferential retainer groove 238, and a spring bearing surface 236, which has an outer diameter that is substantially similar to the collar spring bearing surface 228 outer diameter. The rotor 232 is disposed on the cam shaft 115 so that collar bearing surface 240 is adjacent to the collar's rotor bearing surface 230. When so disposed, both the collar and rotor spring bearing surfaces 228, 236 are aligned. A coil spring 250 is disposed overtop both the collar and rotor spring bearing surfaces 228, 236. The spring 250 has an inner diameter that is slightly smaller than the collar and rotor spring bearing surface 228, 236 diameter. Thus, the spring 250 is constricts or grips the collar and rotor spring bearing surfaces 228, 236 with a radial force. When positioned about the collar spring bearing surface 228, the spring is also disposed within the collar's annular channel 226 between the outer ring 224 and the collar spring bearing surface 228. A housing 252 is disposed overtop the spring 250. The housing 252 has an opening which allows the rotor 232 and the end of the cam shaft 115 to protrude therethrough. The housing abuts the outer ring 224 and is held in place by a retaining ring 254 which is disposed in the rotor retainer groove 238.

Because the spring 250 grips both the stationary collar 222 and the rotating rotor 232, rotation of the cam shaft 115 and rotor 232 will cause the spring 250 to either coil or uncoil. The spring 250 is oriented on the collar 222 and rotor 232 so that when the cam shaft 115 rotates forward, the spring 250 will uncoil and expand. As the spring 250 expands, the radial force against the collar and rotor spring bearing surfaces 228, 236 is decreased and the cam shaft 115 may rotate almost freely. When the cam shaft 115 rotates in the proper direction, the spring 250 provides a slip-torque of approximately 15 inch-pounds. The uncoiling of the spring 250 tends to force the spring 250 off the collar 222 and rotor 232. The spring 250 is retained on the collar 222 and rotor 232 by a retaining means. In the preferred embodiment, the retaining means is the housing 252, however, other means, such as the retaining ring 254 without the housing, may be used. Conversely, when the cam shaft 115 counter-rotates, the spring 250 tends to coil tighter, causing the spring 250 to constrict on the collar 222 and rotor 232. When the spring 250 constricts, the radial force against the collar and rotor spring bearing surfaces 228, 236 increases. The increase in radial force quickly develops a reverse torque of approximately 2000 inch-pounds. Due to the reverse torque, counter-rotation of the cam shaft 115 is virtually eliminated.

While specific embodiments of the invention have been described in detail, it will be appreciated by those skilled in the art that various modifications and alternatives to those details could be developed in light of the overall teachings of the disclosure. For example, those skilled in the art could configure the spring clutch assembly with the collar mounted between the side plates and the cam shaft disposed within collar, but not passing therethrough. Accordingly, the particular arrangements disclosed are meant to be illustrative only and not limiting as to the scope of invention which is to be given the full breadth of the claims appended and any and all equivalents thereof.

What is claimed is:

1. A one-way clutch assembly for an electrical switching apparatus having a close spring coupled to a cam disposed on a cam shaft, wherein said close spring provides a rotational force to said cam shaft in a forward direction, comprising:

a wrap spring clutch assembly disposed on said cam shaft which allows said cam shaft to rotate in said forward direction but which prevents rotation of said cam shaft in the opposite direction.

2. The one-way clutch assembly of claim 1, wherein said wrap spring clutch assembly comprises:

a fixed member attached to said electrical switching apparatus, which is disposed about said cam shaft;

a rotor fixed to said cam shaft adjacent to said fixed member; and a coil spring wrapped about said fixed member and said rotor.

3. The one-way clutch assembly of claim 2, wherein:

said coil spring has a diameter and is wrapped on said fixed member and said rotor so that when said cam shaft is rotated in said forward direction, said coil spring uncoils thereby increasing said coil spring diameter, and when said cam shaft is rotated opposite said forward direction, said coil spring coils thereby constricting said fixed member and said rotor.

4. The one-way clutch assembly of claim 3, wherein:

said fixed member has spring bearing surface with a constant diameter;

said rotor has spring bearing surface with a constant diameter that is substantially the same as said fixed member spring bearing surface diameter; and said coil spring diameter is smaller than said fixed member spring bearing surface diameter and said rotor spring bearing surface diameter.

5. The one-way clutch assembly of claim 4, wherein:

said fixed member is a circular collar; and said rotor is cylindrical.

6. The one-way clutch assembly of claim 5, wherein:

said collar has a medial opening; and said cam shaft passes through said opening.

7. The one-way clutch assembly of claim 6, wherein:

said collar has a U-shaped cross-section and has an outer ring and an inner ring, which has an outer surface, connected by a base forming an annular axial facing channel;

said collar spring bearing surface being said outer surface of said inner ring; and said coil spring being disposed in said annular channel.

8. The one-way clutch assembly of claim 7, wherein said wrap spring clutch assembly further includes a spring retaining means.

9. The one-way clutch assembly of claim 8, wherein the spring retaining means comprises:

said rotor having a circumferential retaining ring groove; and a retaining ring disposed in said retaining ring groove.

10. The one-way clutch assembly of claim 8, wherein the spring retaining means further includes a cylindrical housing disposed around said coil spring.

11. The one-way clutch assembly of claim 10, wherein:

said housing has a medial opening therethrough; and said cam shaft and a portion of said rotor passing through said housing opening.

12. The one-way clutch assembly of claim 11, wherein:

said housing is retained by a retaining ring disposed in said retaining ring groove.

* * * * *